United States Patent [19]

Pringle et al.

[11] Patent Number: 4,688,593

[45] **Date of Patent: * Aug. 25, 1987**

[54] WELL REVERSE FLOW CHECK VALVE

[75] Inventors: Ronald E. Pringle, Houston; Arthur J. Morris, Magnolia, both of Tex.

[73] Assignee: Camco, Incorporated, Houston, Tex.

[ * ] Notice: The portion of the term of this patent subsequent to Jul. 22, 2003 has been disclaimed.

[21] Appl. No.: 809,645

[22] Filed: Dec. 16, 1985

[51] Int. Cl.[4] ..... F16K 17/34; F16K 1/40; G05D 7/01

[52] U.S. Cl. ..... 137/116; 137/70; 137/508; 166/317; 166/332

[58] Field of Search ..... 137/102, 107, 117, 504, 137/70, 515, 508, 71, 116; 166/317, 319, 332

[56] References Cited

U.S. PATENT DOCUMENTS

| | | | |
|---|---|---|---|
| 2,250,465 | 7/1941 | Boynton | 137/155 X |
| 2,805,043 | 9/1957 | Williams, Jr. | 137/117 X |
| 2,859,762 | 11/1958 | Banker | 137/116 X |
| 2,921,601 | 1/1960 | Fisher | 137/504 X |
| 2,994,280 | 8/1961 | Doffin | 166/332 X |
| 3,381,708 | 5/1968 | Chenoweth | 137/504 |
| 3,451,416 | 6/1969 | Nyberg | 137/116 |
| 4,081,032 | 3/1978 | Hutchison et al. | 166/317 |
| 4,154,303 | 5/1979 | Fournier | 166/319 X |
| 4,427,070 | 1/1984 | O'Brien | 137/70 X |
| 4,494,608 | 1/1985 | Williams et al. | 137/70 X |
| 4,601,342 | 7/1986 | Pringle | 166/323 |

*Primary Examiner*—Martin P. Schwadron
*Assistant Examiner*—Stephen M. Hepperle
*Attorney, Agent, or Firm*—Fulbright & Jaworski

[57] ABSTRACT

A reverse flow check check valve for use in a pumping well to prevent backflow when the pump is shut down in which the valve has pump through capabilities for killing the well. The valve includes a housing having a bore with a valve closure element in the bore. A flow tube telescopically moves in the housing upwardly for opening and downwardly for actuating the closing of the member. The flow tube is biased downwardly, preferably by weight, for closing the valve and is responsive to a pressure drop for holding the valve element open. The housing has a port initially closed, but may be opened for pumping through the valve.

7 Claims, 5 Drawing Figures

WELL REVERSE FLOW CHECK VALVE

BACKGROUND OF THE INVENTION

In many wells, such as oil and gas wells, a submersible pump, such as an electrically operated pump, is requried to pump fluid from the well to the surface. In these wells it has been necessary to utilize a reverse flow check valve in the tubing string above the pump to prevent backflow of the well fluid to the formation when the pump is shut down. Backflow of the production fluid to the formation is generally not desirable as it sometimes results in formation damage. Another reason for the use of the reverse flow check valve is that reverse fluid flow through most electrical submersible pumps results in pump damage. Presently the reverse flow check valves being generally used consist of a ball and seat. However, this type of valve has short life due to the continuous contact of the production flow path with and erosion of the valve ball and seat.

The present invention is directed to the provision of a reverse flow check valve which is dependable, has a long life and one in which reverse flow pump through capabilities can be provided if it is desired to kill the well.

SUMMARY

The present invention is directed to a reverse flow check valve for a well which includes a housing having a bore and is adapted to be placed in a well. Valve closure means are provided in the bore moving between open and closed positions for allowing upward flow of fluid through the bore but preventing downward flow of fluid through the bore. A flow tube is telescopically movable in the housing upwardly for opening and protecting the valve closure member and seat and downwardly for actuating the closing of the valve closure means. Means are connected to the flow tube for biasing the flow tube downwardly for closing the valve and pressure responsive means is connected to the flow tube for moving the flow tube upwardly in response to an upward flow rate pressure drop for opening the valve closure means. The housing has a port between the bore and the outside of the housing. The valve closure means is releasably connected to the housing and initially blocks the port but can be moved downwardly for opening the port for allowing the valve to pump fluid downwardly through the valve if desired.

Still a further object of the present invention is wherein the biasing means is a weight which when the valve starts to open requires no additional force to continue the travel to a full opening position.

Still a further object of the present invention is wherein the pressure responsive means is an expandable and contractable restriction connected to the flow tube and extending into the bore.

Yet a still further object of the present invention is wherein the valve closure means includes a valve element and a valve seat connected to a support which is releasably connected but movable in the housing for initially blocking the port but which can be moved downwardly by fluid pressure to uncover the port.

Still a further object of the present invention is wherein spring means are provided between the housing and the support for moving the valve closure means past the port when the support is released from the housing.

Still a further object is the provision of a reverse flow check valve for use in a well above a submersible pump. The valve includes valve closure means in a bore in a housing in which the valve closure means includes a valve element, and a valve seat connected to a support. The housing includes a port between the bore and the outside of the housing. The valve support is releasably connected to the housing and initially blocks the port but upon release moves downwardly to uncover the port. A flow tube telescopically moves in the housing upwardly and downwardly for actuating the valve closure means. Biasing means acts on the flow tube downwardly for closing the valve and a variable radially retractable choke moves the flow tube upwardly in response to upward fluid flow in the bore. The choke includes a plurality of segments movable into and out of the bore by biasing means yieldably urging the segments into the bore.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1A:
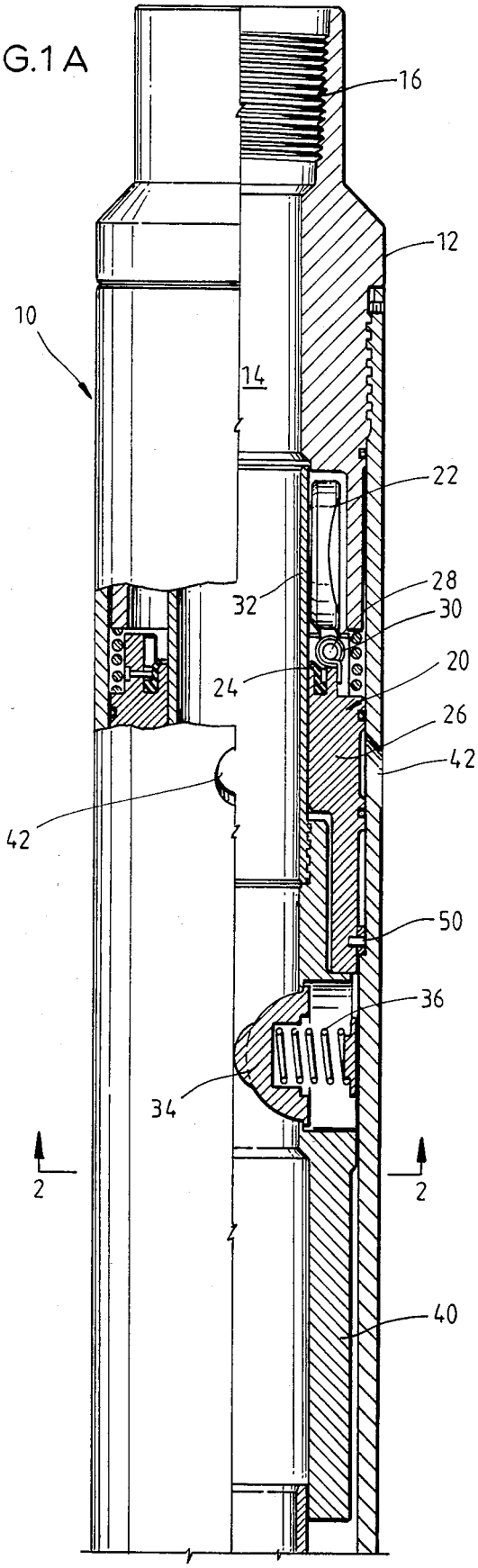
FIG. 1A and 1B are continuations of each other and are elevational views, partly in cross section, of the reverse flow check valve of the present invention shown in the open position.
Figure 1B:
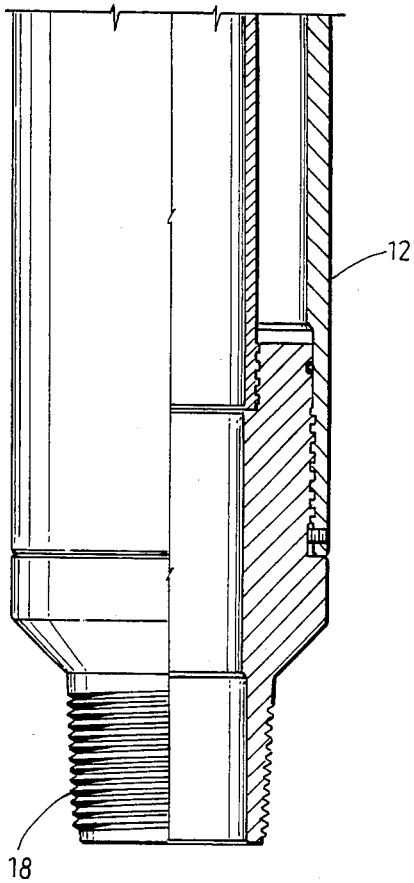
Figure 2:
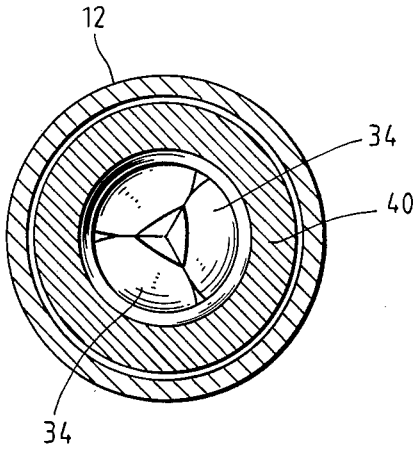
FIG. 2 is a cross-sectional view taken along the line 2—2 of FIG. 1A.

Referring now to the drawings and particularly to FIGS. 1A, 1B and 2, the reference numeral 10 generally indicates the reverse flow check valve of the present invention and includes à housing 12 having a bore 14 therethrough. The housing includes connections 16 and 18 at opposite ends for connection in a well tubing above an electrical submersible pump and positioned inside of a casing for pumping well fluids such as oil and gas from a well formation to the well surface.

The use of reverse flow check valves in such applications are conventional to prevent backflow to the well formation when the pump is shut off and to prevent reverse fluid flow from damaging the pump. However, such check valves generally consist of a ball and seat which are in continuous contact with the fluid flow through the check valve. The valve is subjected to erosion and consequently has a short life.

Valve closure means generally indicated by the reference numeral 20 includes a valve element 22 such as a flapper valve, a valve seat 24, both of which are connected to a support 26. The valve element or flapper 22 is pivotally connected to the support 26 about a pin 28 and yieldably urged to a seating position on the valve seat 24 by a spring 30. The flapper valve 22 is positioned to open and close the bore 14 for allowing upward flow of well fluids through the bore 14 when pumping but preventing downward flow of fluids through the bore 14 thus preventing the fluids from flowing to the well formation or to a submersible electric pump positioned below the valve 10.

A flow tube 32 is telescopically movable in the housing 12 and is adapted to move upwardly through the valve seat 24, engage the flapper valve element 22 and open the valve as best seen in FIG. 1A. When the flow tube 32 is moved downwardly beyond the seat 24, the valve element 22 will move inwardly and seat on the valve seat 24 (FIG. 3) by the action of the spring 30 for preventing downwardly flow through the bore 14. It is to be noted in FIG. 1A that when the flow tube 32 is moved upwardly opening the valve that the flow tube 32 protects the seat 24 and valve element 22 from erosion by the flowing well production fluid through the bore 14.

Pressure responsive means are connected to the flow tube for moving the flow tube 32 upwardly in response to an upward fluid flow rate pressure drop for opening the valve closure member 22. The pressure responsive means may take the form of an expandable and contraction restriction means which extends into the bore 14 for creating a pressure differential as pump fluid passes upwardly for moving the flow tube 32 to the open position in response to the pumped fluid such as described in copending patent application Ser. No. 710,360, filed Mar. 11, 1985 by Roland E. Pringle, which is assigned to the assignee of the present application. The expandable and contractable restriction may include a plurality of radially movable segments 34 which are biased inwardly into the bore 14 by biasing members such as springs 36. While the number of the segments 34 may be any suitable number, they are shown as three segments 34, radially positioned about the bore 14. The segments 34 are preferably rounded which engage each other when expanded to restrict the size of the bore 14 and provide a differential force across the segments 34 sufficient to open the valve 10. As the flow rate increases, the flow rate will expand the segments 34 outwardly to increase the size of the opening through the segments for increasing the fluid flow through the bore 14 but still providing a sufficient differential force across the segments 34 to maintain the valve 10 in the open position.

Biasing means are provided connected to the flow tube 32 for biasing the flow tube 32 downwardly for allowing the valve element 22 to close. While this means may be a spring between the housing 12 and the flow tube 32, it is preferable that it is a weight 40 connected to the flow tube 32. The weight has the advantage that when the fluid flow actuates the pressure responsive means 34 sufficiently to move the weight 40 upwardly, the weight 40 and the flow tube 32 will continue to travel to their full opening position as distinguished from a spring which would have increased spring rate and require additional force to continue to move the flow tube to full opening. However, with the weight 40 no additional differential force on the segments 34 is required to continue and completely open the valve element 22 after the weight 40 is initially overcome.

In normal operation, when the pump positioned below the valve 10 is actuated, fluid flow starts from the well formation through the well tubing and the valve 10 which will create a fluid flow and a pressure drop across the segments 34 to create a force to lift the flow tube 32 and valve element 22 to the open position shown in FIG. 1A. At the same time the segments 34 will expand outwardly thereby increasing the fluid flow through the bore 14 but still providing a sufficient differential force across the segments 34 to maintain the valve 10 in the open position. In the event that the pump is shut off, fluid flow stops, the weight 40 biases the flow tube 32 to the lower position allowing the flapper valve 22 to close on the valve seat 24.

Figure 3:
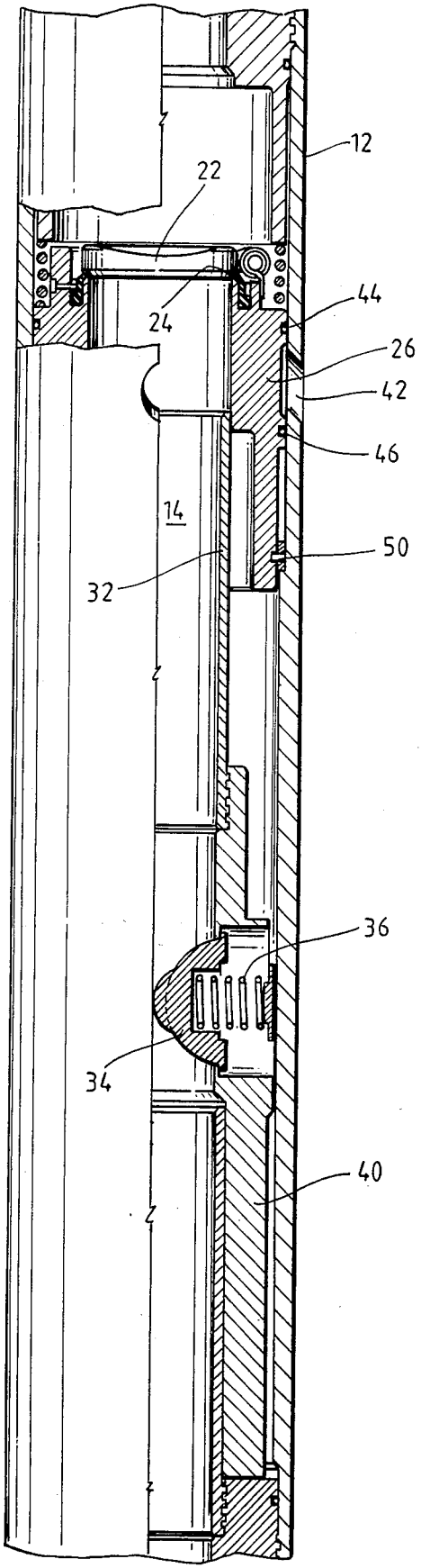
FIG. 3 is a fragmentary enlarged elevational view, partly in cross section, illustrating the valve of FIGS. 1A and 1B in the closed position.
Figure 4:
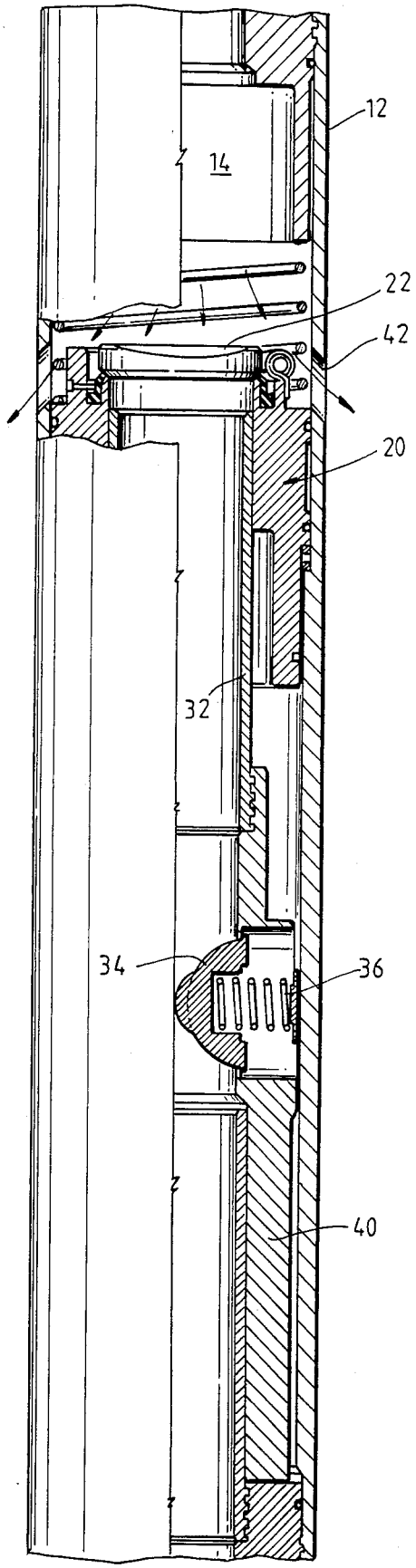
FIG. 4 is a fragmentary enlarged elevational view, partly in cross section, illustrating the valve of FIGS. 1A and 1B in which the valve closure means has been shifted downwardly and fluid is being pumped downwardly through the valve.

On the occurrence of some conditions, it is sometimes desirable to kill an oil and/or gas well. That is, stop its production by pumping mud or other fluids down the well. Normally this cannot be done through a reverse flow check valve. However, the present valve features a pump through capability even with the flapper element 22 closed. The valve housing includes one or more ports 42 which are in communication between the outside of the housing 12 and the bore 14, but are normally blocked and shut off by the valve closure means 20. That is, the support 26 of the valve closure means includes seal means 44 and 46 on opposite sides of the ports 42 for normally and initially blocking the ports 42. The support 26 is releasably connected to the housing 12 such as by shear pin 50. Therefore, in the event that it is desired to pump fluid down the well tubing and out the valve 10 into the annulus between the well tubing and the casing and into the well formation, the pump is shut off allowing the valve to move to the closed position as best seen in FIG. 3. After this, pressure is applied at the well surface on top of the flapper valve 22 against the valve closure means 20 to shear the pin 50 and move the valve closure means 20 downwardly as best seen in FIG. 4. This uncovers the ports 42 allowing downwardly fluid flow through the well tubing and bore 14 and out of the ports 42.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A well reverse flow check valve for use in a well tubing comprising, a housing having a bore and adapted to be placed in a well production tubing above an electrical submersible pump, flapper valve element in the bore moving between open and closed positions for allowing upward flow through the bore but preventing downward flow through the bore, a flow tube telescopically movable in the housing upwardly for opening said flapper valve element, and downwardly for actuating the closing of the flapper valve element, means connected to the flow tube for biasing the flow tube downwardly for closing the flapper valve element, pressure responsive means connected to the flow tube for moving the flow tube upwardly in response to an upward flow rate pressure drop for opening the flapper valve element open, said housing having a port between the bore and the outside of the housing, valve closure means releasably connected to the housing and initially blocking said port, said pressure responsive means is an expandable and contractible restriction connected to the flow tube and extending into the bore, said port in uncovered when the valve closure means is moved downwardly, and the valve closure means includes said flapper valve element and a valve seat connected to a support which is releasably connected to the housing.

2. The apparatus of claim 1 wherein the biasing means is a weight.

3. The apparatus of claim 1 including, spring means between the housing and the support for moving the valve closure means past the port when the support is released from the housing.

4. A reverse flow check valve for use in a well above a submersible pump comprising, a housing having a bore and adapted to be placed in a well conduit above an electrical submersible pump, said housing having a port between the bore and the outside of the housing, valve closure means including a flapper valve element and valve seat connected to a support and releasably connected to the housing and initially blocking said port but upon release is movable downwardly to uncover said port, said flapper valve element allowing upward flow through the bore but preventing downward flow through the bore, a flow tube telescopically movable in the housing upwardly for opening said flapper valve element, and downwardly for actuating the closing of the flapper valve element, means connected to the flow tube for biasing the flow tube downwardly for closing the flapper valve element, and a variable, radially retractable choke connected to the flow tube and extending into the bore for moving the flow tube upwardly in response to upward fluid flow in the bore.

5. The apparatus of claim 4 wherein the biasing means is a weight.

6. The apparatus of claim 4 including spring means between the housing and the support for moving the valve closure means downwardly past the port when the support is released from the housing.

7. The apparatus of claim 4 wherein the choke includes, a plurality of segments movable into the bore into engagement with each other closing said bore and out of said bore, and biasing means yieldably urging said segments into said bore.

* * * * *

UNITED STATES PATENT OFFICE

CERTIFICATE OF CORRECTION

PATENT NO. : 4,688,593

DATED : August 25, 1987

INVENTOR(S) : Ronald E. Pringle et al.

It is certified that error appears in the above-identified patent and that said Letters Patent are hereby corrected as shown below:

Column 1, line 7, delete "requried" and insert -- required --

Column 3, line 28, delete "Roland" and insert -- Ronald --

Column 5, line 4, delete "in" and insert -- is --

Signed and Sealed this

Twenty-sixth Day of January, 1988

*Attest:*

DONALD J. QUIGG

*Attesting Officer*

*Commissioner of Patents and Trademarks*